US011305562B2

(12) United States Patent
Kim et al.

(10) Patent No.: US 11,305,562 B2
(45) Date of Patent: Apr. 19, 2022

(54) IMAGE FORMING APPARATUS FOR PAPER ALIGNMENT

(71) Applicant: HEWLETT-PACKARD DEVELOPMENT COMPANY, L.P., Spring, TX (US)

(72) Inventors: Taehong Kim, Pangyo (KR); Stephen Thomas Rohman, Vancouver, WA (US); Matthew Raisanen, Vancouver, WA (US); Sundae Kim, Seoul (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/050,154

(22) PCT Filed: May 10, 2019

(86) PCT No.: PCT/US2019/031792
§ 371 (c)(1),
(2) Date: Oct. 23, 2020

(87) PCT Pub. No.: WO2019/217865
PCT Pub. Date: Nov. 14, 2019

(65) Prior Publication Data

US 2021/0138806 A1 May 13, 2021

(30) Foreign Application Priority Data

May 11, 2018 (KR) ..... 10-2018-0054429

(51) Int. Cl.
*B41J 13/00* (2006.01)
*B41J 13/03* (2006.01)
*B41J 13/10* (2006.01)

(52) U.S. Cl.
CPC ..... *B41J 13/0036* (2013.01); *B41J 13/03* (2013.01); *B41J 13/106* (2013.01)

(58) Field of Classification Search
CPC ..... B41J 13/0036; B41J 13/03; B41J 13/106; B65H 2301/51256; B65H 2403/942; B65H 2404/1114; B65H 31/36; B65H 31/02
See application file for complete search history.

(56) References Cited

U.S. PATENT DOCUMENTS 5,473,420 A 12/1995 Rizzolo et al.
5,772,198 A 6/1998 Yamamoto
(Continued)

FOREIGN PATENT DOCUMENTS

CN 1724326 1/2006
CN 103030015 4/2013
(Continued)

*Primary Examiner* — Henok D Legesse
(74) *Attorney, Agent, or Firm* — Staas & Halsey LLP

(57) ABSTRACT

An image forming apparatus is provided. The image forming apparatus includes a printing engine, a paddle device, a stapler device, and a processor. The printing engine is to form an image on a printing paper. The paddle device is to move the printing paper ejected from the printing engine in a moving direction to align a first end of the printing paper. The stapler device is to staple the align printing paper. The processor is to control the paddle device and the stapler device to move a second end of the aligned printing paper in an opposite direction to the moving direction when the first end of the printing paper is aligned.

15 Claims, 7 Drawing Sheets

(56) References Cited

U.S. PATENT DOCUMENTS

| | | | | |
|---|---|---|---|---|
| 6,898,395 | B2 | 5/2005 | Mui et al. | |
| 2014/0300047 | A1 | 10/2014 | Yamamoto et al. | |
| 2015/0028539 | A1 | 1/2015 | Dinnissen | |
| 2017/0322508 | A1* | 11/2017 | Taki ..... | G03G 15/6538 |

FOREIGN PATENT DOCUMENTS

| | | | |
|---|---|---|---|
| EP | 3241792 | A1 | 11/2017 |
| JP | 11-301912 | | 11/1999 |
| JP | 20030020154 | A | 1/2003 |
| JP | 20100001149 | A | 1/2010 |
| JP | 2013079122 | A | 5/2013 |

* cited by examiner

【Figure 1】
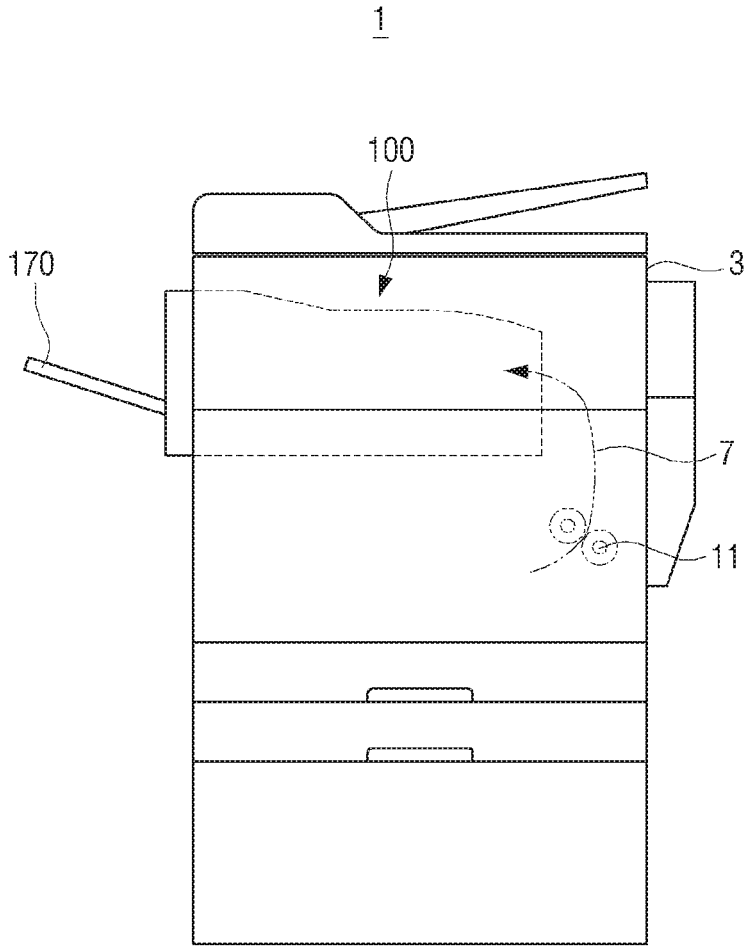

【Figure 2】
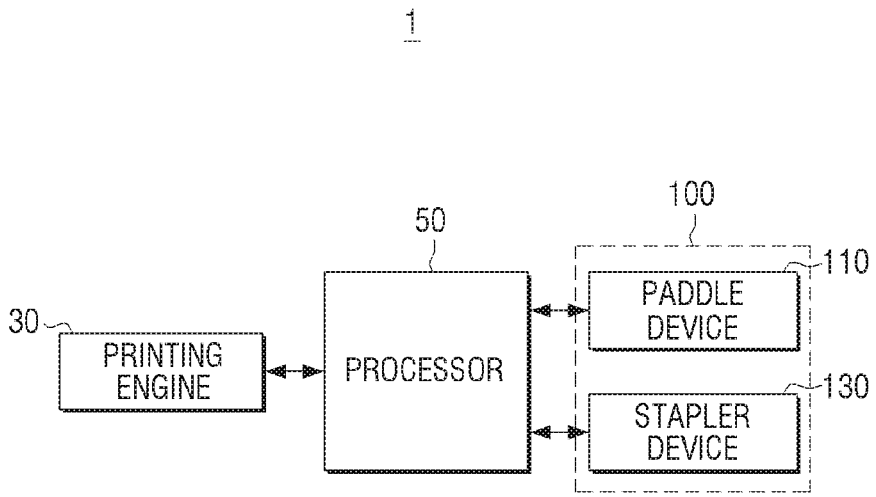

【Figure 3】
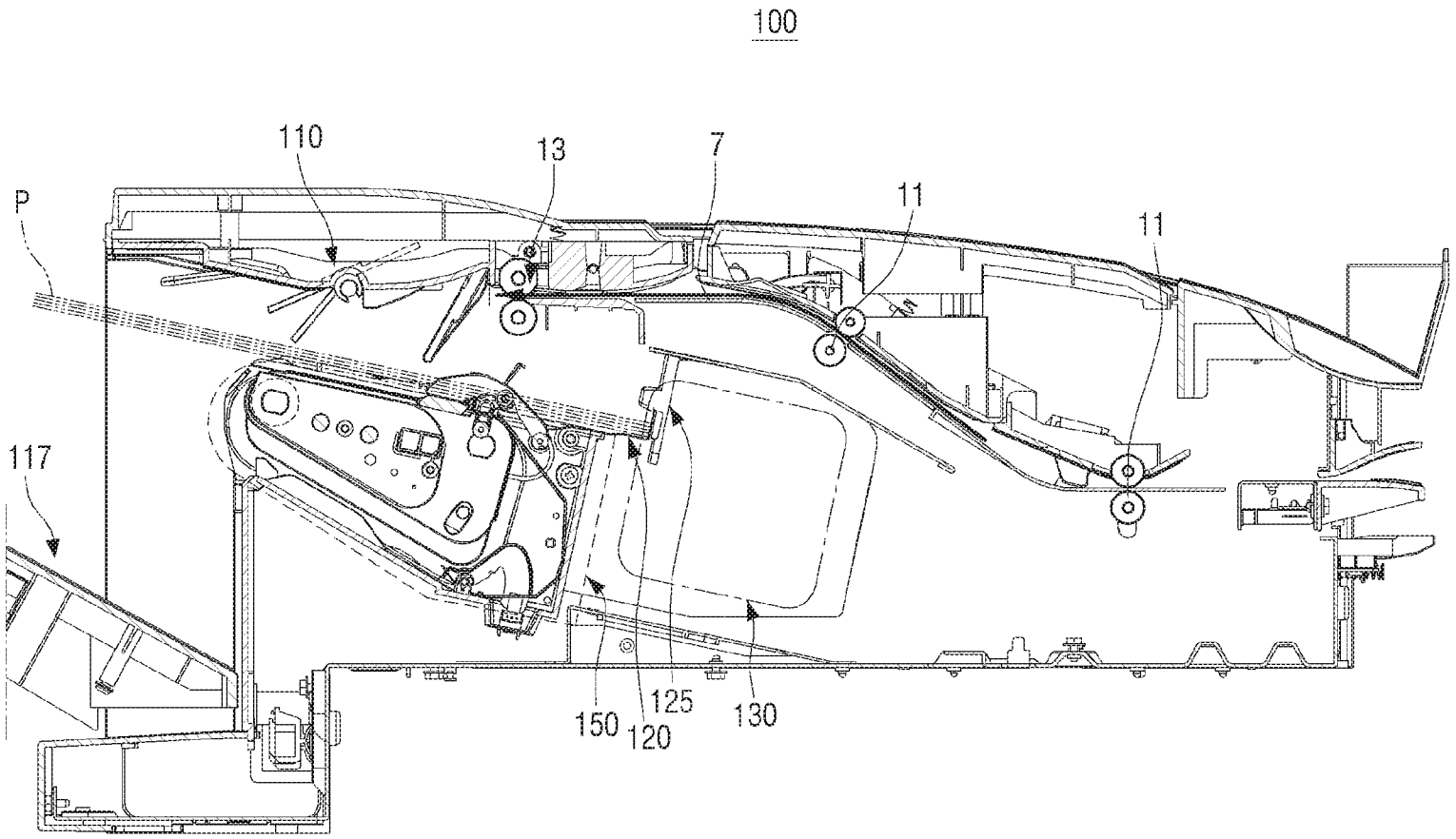

【Figure 4】
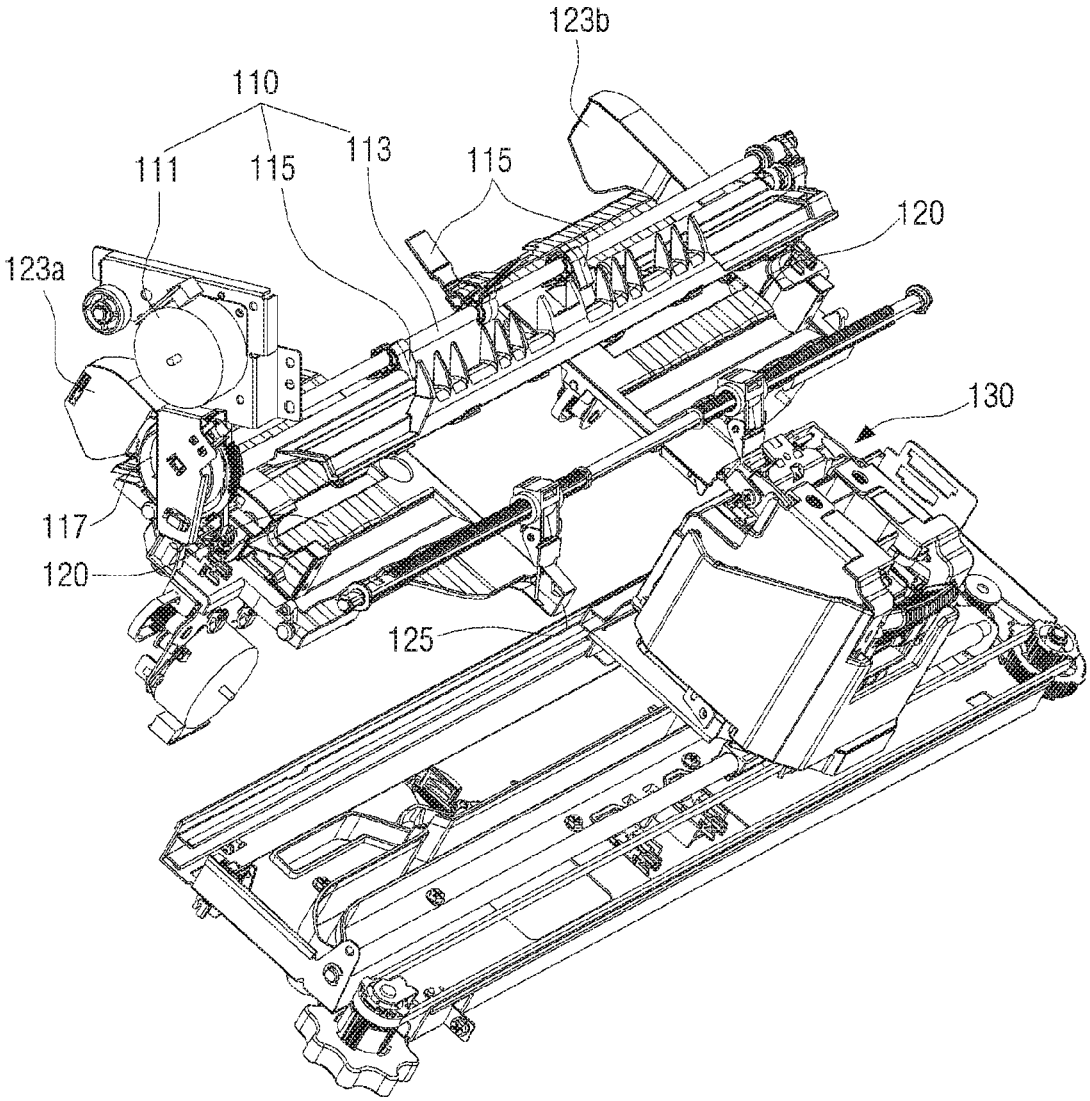

【Figure 5】
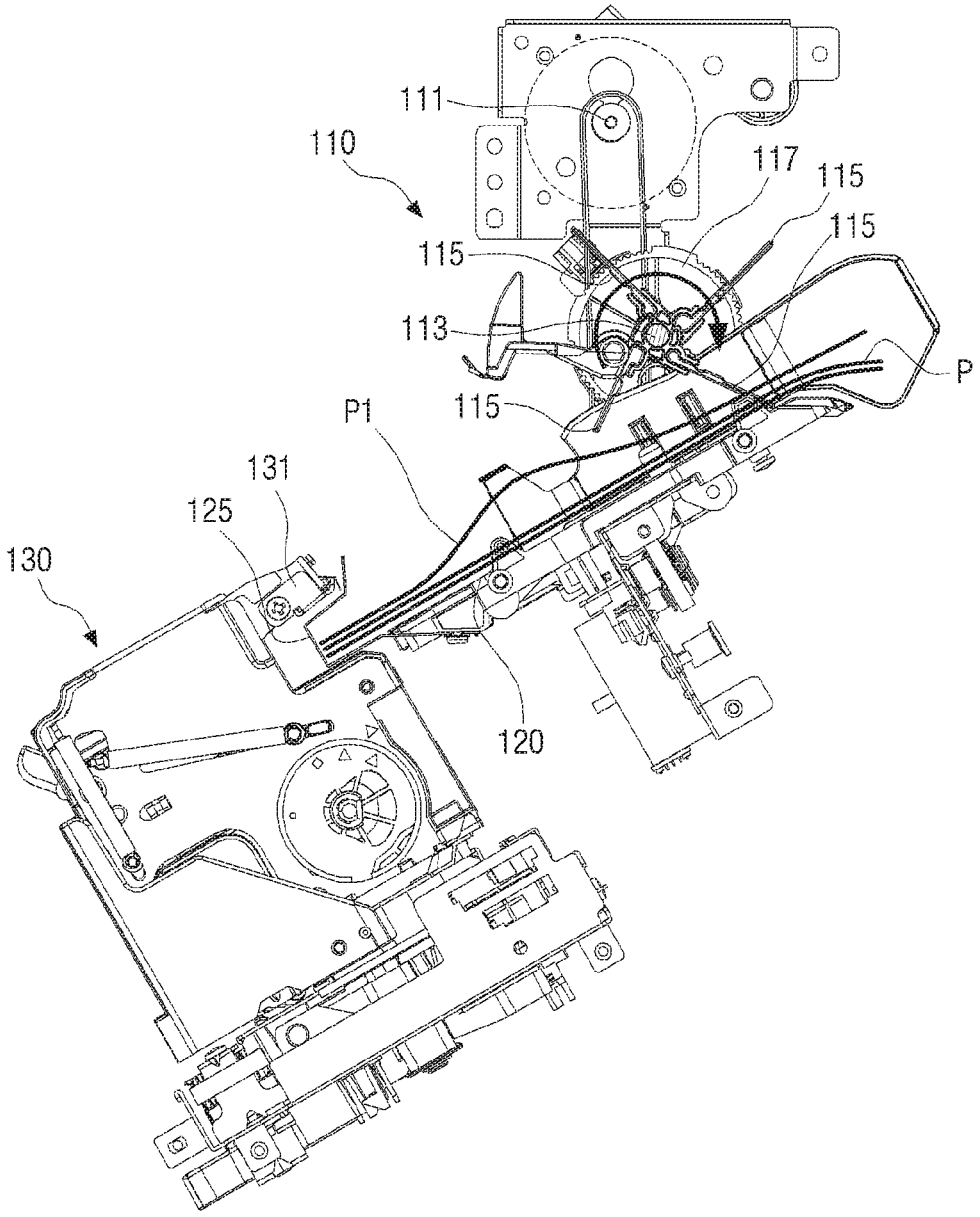

【Figure 6】
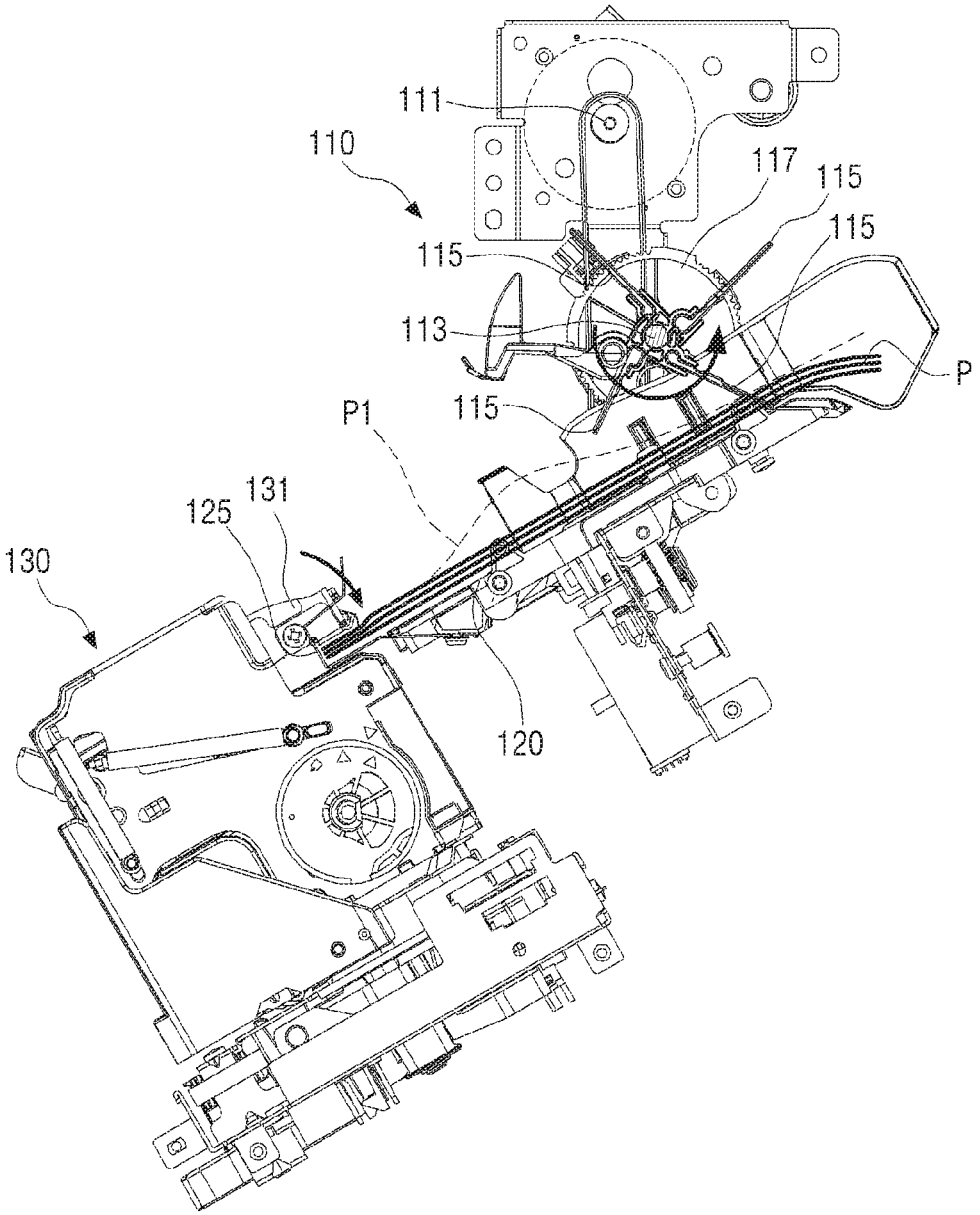

【Figure 7】
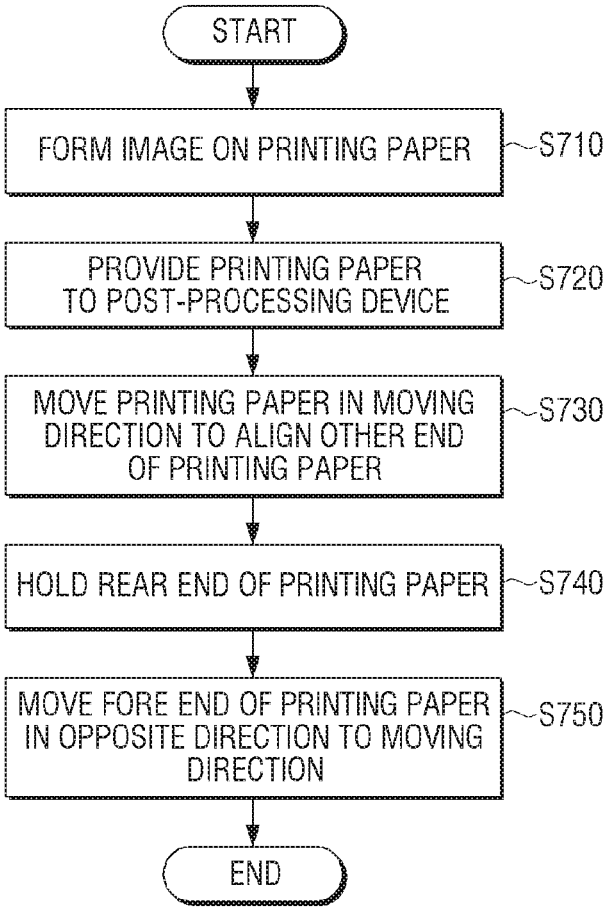

IMAGE FORMING APPARATUS FOR PAPER ALIGNMENT

CROSS REFERENCE TO RELATED APPLICATIONS

This application is a U.S. National Stage Application which claims the benefit under 35 U.S.C. § 371 of International Patent Application No. PCT/US2019/031792 filed on May 10, 2019, which claims priority from Korean Application No. 10-2018-0054429 filed on May 11, 2018, the contents of each of which are incorporated herein by reference.

BACKGROUND

A print medium post-processing device is connected to an image forming apparatus such as a printer or a multi-function printer, receives printing media on which an image is completely formed, from the image forming apparatus, and performs various post-processing processes on the printing media.

Such a print medium post-processing device is capable of performing a function of an alignment job for aligning printing media, a punching job for punching the printing media to form a hole for filing the printing media, a stapling job for bonding a plurality of printing media into one group via a stapler, a binding job for folding a plurality of printing media about a center thereof in the form of a book, and so on.

BRIEF DESCRIPTION OF THE DRAWINGS

FIG. 1 is a schematic diagram showing an image forming apparatus including a post-processing device installed therein according to an example of the present disclosure;

FIG. 2 is a block diagram showing a simple configuration of an image forming apparatus according to an example of the present disclosure;

FIG. 3 is a cross-sectional view of a post-processing device according to an example of the present disclosure;

FIG. 4 is a schematic perspective view of a paddle device and a stapler device of a post-processing device according to an example of the present disclosure;

FIG. 5 is a diagram for explanation of an operation of aligning a rear end of a printing paper by a paddle device according to an example of the present disclosure;

FIG. 6 is a diagram for explanation of an operation of removing paper curling by a paddle device according to an example of the present disclosure; and FIG. 7 is a flowchart for explanation of a method for paper alignment according to an example of the present disclosure.

DETAILED DESCRIPTION

Certain examples of the present disclosure will now be described in greater detail with reference to the accompanying drawings. The present disclosure may be embodied in many different forms.

In the specification, when it is described that a certain part is "connected" to another part, it should be understood that the certain part may be directly connected to another part or electrically connected to another part via another part in the middle. In addition, when a certain part "includes" a certain component, this indicates that the part may further include another component instead of excluding another component unless there is no different disclosure.

In the specification, the term "image forming job" refers to various jobs (e.g., print, scan, or facsimile transmission) related to an image, such as image forming or image file generation/storage/transmission, and the term "job" refers to all series of processes to perform the image forming job as well as the image forming job.

The term "image forming apparatus" refers to an apparatus for printing print data generated by a terminal such as a computer on a recording sheet. The image forming apparatus may be, for example, a copier, a printer, a fax machine, or a multi-function printer (MFP) that multiply embodies functions thereof thorough one device. The image forming apparatus may refer to any device for performing an image forming job, such as a printer, a scanner, a fax machine, a multi-function printer (MFP), or a display device.

The term "hard copy" may refer to an operation of outputting an image on a printing medium such as paper and the term "soft copy" may refer to an operation of outputting an image on a display device such as a television (TV) or a monitor.

The term "content" may refer to any type of data as a target of an image forming job, such as a picture, an image, or a document file.

The term "print data" may refer to data that is converted in printable format by a printer. When a printer supports direct printing, a file without a change may be print data.

In addition, the term "user" may refer to a person who performs manipulation related to an image forming job using an image forming apparatus or a device that is connected to an image forming apparatus by wire or wirelessly. The term "manager" may refer to a person who is capable of accessing any function and system of an image forming apparatus. The "manager" and the "user" may be the same person.

FIG. 1 is a schematic diagram showing an image forming apparatus including a post-processing device installed therein according to an example of the present disclosure.

Referring to FIG. 1, an image forming apparatus 1 according to an example of the present disclosure may include a body 3, a feed roller 11, a feed path 7, and a post-processing device 100 arranged on an internal upper end portion of the image forming apparatus 1. The feed roller 11 of the image forming apparatus 1 may sequentially eject a printing paper, on which printing is completed, toward the post-processing device 100 through the feed path 7.

The image forming apparatus 1 may transmit a printing paper P fed under control of a processor 50 (Refer to FIG. 2) to the post-processing device 100 through the feed path 7 in the image forming apparatus 1. The post-processing device 100 may perform at least any one of alignment and post-processing jobs and, then, eject the printing paper P transmitted from the image forming apparatus 1 to a tray 170.

FIG. 2 is a block diagram showing a simple configuration of an image forming apparatus according to an example of the present disclosure.

Referring to FIG. 2, the image forming apparatus 1 may include a printing engine 30, the processor 50, and the post-processing device 100. The post-processing device 100 may include a paddle device 110 and a stapler device 130.

The printing engine 30 may perform an image forming job. In detail, the printing engine 30 may perform an image forming job by forming an image on an image forming medium and performing an operation of transferring the formed image on a printing paper.

The printing engine 30 may form an image on the fed printing paper P through a predetermined image forming process such as electrophotography, thermal printing, and inkjet printing. A configuration of the printing engine 30 is widely known and, thus, a detailed description thereof is omitted herein.

The post-processing device 100 may be configured to receive the printing paper, on which printing is completed, ejected from the image forming apparatus 1 and to selectively perform a punching job, a stapling job for bonding a plurality of printing papers into one group, or a binding job for folding a plurality of printing papers about a center thereof in the form of a book, and so on.

The post-processing device 100 may include the paddle device 110 for paper alignment and the stapler device 130 for binding a plurality of printing papers into one group. Although FIG. 2 illustrates the case in which the post-processing device 100 includes the paddle device 110 and the stapler device 130, the present disclosure is not limited thereto and the post-processing device 100 may further include various devices for post-processing a printing paper. A configuration of the post-processing device 100 is described below in detail with reference to FIGS. 3 and 4.

The processor 50 may control components in the image forming apparatus 1. Upon receiving a print command, the processor 50 may control the printing engine 30 to receive the printing paper P and to form an image and may control the printing engine 30 to provide the printing paper P on which an image is formed, to the post-processing device 100. The processor 50 may control the post-processing device 100 to perform a post-processing job such as binding, folding, stapling, and punching on the printing paper P, on which an image is formed, according to the print command.

When the received print command does not include a post-processing job, the processor 50 may control the paddle device 110 to align the printing papers P ejected from the printing engine 30 and may control an ejector device 150 (refer to FIG. 3) to eject the plurality of aligned printing papers P to the tray 170.

When the received print command includes a post-processing job, the processor 50 may control the paddle device 110 to align the printing papers P ejected from the printing engine 30, may control the stapler device 130 to staple one end of the plurality of aligned printing papers and may control the ejector device 150 to eject the plurality of stapled printing papers P to the tray 170.

In particular, to align the printing papers P ejected from the printing engine 30, the processor 50 may control the paddle device 110 to move the printing papers P provided to the post-processing device 100 from the printing engine 30 in a moving direction and to load the printing papers P and may control the paddle device 110 and the stapler device 130 to move the other end of the loaded printing paper P in an opposite direction to the moving direction.

The paddle device 110 may contact an upper surface of the printing paper P to move the printing paper P in a moving direction. An end fence 125 (refer to FIG. 4) for aligning rear ends of the printing papers P may be formed behind a loading portion 120 (refer to FIG. 4). In this case, a moving direction may refer to a backward direction of the loading portion 120.

In this case, a rear end of the printing paper P may slip when comes in contact with the end fence 125, that is, the printing paper P may curl (refer to a printing paper P1 of FIG. 5). The post-processing device 100 has a limited space for a post-processing job or paper alignment and, thus, when the printing paper curls, the number of printing papers to be loaded may be reduced. When a plurality of printing papers that need to be post-processed are not loaded in the space for a post-processing job or paper alignment, an error may arise in the post-processing job.

To prevent a printing paper from curling, the processor 50 may control the stapler device 130 to hold one end of a loaded printing paper and may control the paddle device 110 to move the other end of the printing paper P, which is loaded after one end of the loaded paper is held, in an opposite direction to the moving direction.

That is, the processor 50 may control the paddle device 110 and the stapler device 130 to prevent the printing paper P from curling which may occur during an alignment procedure of the printing paper P.

The post-processing device 100 according to an example of the present disclosure may move the other end of the loaded printing paper P in an opposite direction to the moving direction irrespective of whether a print command includes a post-processing job to prevent the printing paper P from curling during an alignment procedure of the printing paper P.

The processor 50 may control the paddle device 110 and the stapler device 130 to move the other ends of loaded printing papers in the opposite direction to the moving direction for each printing paper P ejected from the printing engine 30. The paddle device 110 may move the other end of the printing paper P in the opposite direction of the moving direction for each of the loaded printing papers P and, thus, the printing paper may be completely prevented from curling.

The processor 50 may control the paddle device 110 to be normally rotated for a predetermined time period and, then, to be reversely rotated for a predetermined time period for each of the ejected printing papers P. While the paddle device 110 is normally rotated, the printing paper P may be moved in a direction toward the end fence 125. A rear end of the printing paper P moved to the end fence 125 may be aligned by the end fence 125.

A rear end of the printing paper is aligned by the end fence 125 and, then, one end of the printing paper P may be held by the stapler device 130. After one end of the printing paper is held, the paddle device 110 may be reversely rotated to move the other end of the printing paper, which is opposite to the held end, in an opposite direction to the end fence 125. The other end of the printing paper may be a non-fixed free end and may be freely moved by the paddle device 110.

The stapler device 130 may have a holding mode in which one end of an aligned printing paper is held and a stapling mode in which one end of the aligned printing paper is stapled. The processor 50 may control the stapler device 130 to operate in a holding mode during a printing job for printing a plurality of sheets. During a procedure of aligning the printing paper P during the printing job, the stapler device 130 may hold the printing paper P to temporally fix one end of the printing paper P. The stapler device 130 may operate in a holding mode in which the printing paper P is held while the paddle device 110 is reversely rotated.

The processor 50 may control the stapler device 130 to operate in a stapling mode when a printing job is terminated. When the received print command includes a stapling post-processing job, the stapler device 130 may operate in a stapling mode in which a plurality of printing papers are bonded into one group when the printing job is terminated.

The processor 50 may control the paddle device 110 in such a way that at least one of driving time and driving speed at which the paddle device 110 is normally rotated is different from a driving state in which the paddle device 110 is reversely rotated. For example, the processor 50 may control the paddle device 110 to lengthen driving time for normally rotating the paddle device 110 to move the ejected printing paper P in the moving direction compared with driving time for reversely rotating the paddle device 110 to move the other end of the loaded printing paper P in an opposite direction to the moving direction. To remove paper curling, driving for moving the other end of the printing paper P in the opposite direction to the moving direction may be performed for a shorter time period than driving for actually moving the printing paper P. Accordingly, the paddle device 110 may be driven at different driving time or driving speed during reverse rotation and normal rotation.

FIG. 3 is a cross-sectional view of a post-processing device according to an example of the present disclosure. FIG. 4 is a schematic perspective view of a paddle device and a stapler device of a post-processing device according to an example of the present disclosure.

Referring to FIG. 3, the post-processing device 100 according to an example of the present disclosure may be configured to receive the printing paper, on which printing is completed, ejected from the image forming apparatus 1, to align the plurality of printing papers, and to selectively perform a post-processing job such as a stapling job for bonding a plurality of printing papers into one group.

The post-processing device 100 may be mounted on the image forming apparatus 1, may be connected to an eject portion of the printing engine 30, may receive the printing papers P ejected through an eject roller 13, and may post-process the printing papers P. The post-processing device 100 according to an example of the present disclosure may be detachably installed on the image forming apparatus 1 and, thus, when the printing papers P need to be post-processed, the post-processing device 100 may be coupled to the image forming apparatus 1 and may be selectively used. The post-processing device 100 may include a plurality of feed rollers 11, the eject roller 13, the paddle device 110, the loading portion 120, the end fence 125, a pair of alignment members 123*a* and 123*b*, and the stapler device 130.

The post-processing device 100 may further include the tray 170 for loading a plurality of aligned printing papers or a plurality of printing papers on which a post-processing job is completely performed, and the ejector device 150 for moving the printing papers that are aligned by the loading portion 120 and are completely post-processed, to the tray 170. The plurality of printing papers P aligned by the loading portion 120 or the printing papers P that are aligned and completely post-processed may be ejected to the tray 170 by the ejector device 150.

The post-processing device 100 may include the feed path 7 for guiding the printing papers P transmitted from the printing engine 30 to the loading portion 120, and the plurality of feed rollers 11 arranged on the feed path 7 to move the printing paper P along the teed path 7. Although FIG. 3 illustrates the case in which the post-processing device 100 includes a feed path, a feed roller, and an eject roller, the present disclosure is not limited thereto and, thus, the feed path, the feed roller, and the eject roller may be included in a portion of the image forming apparatus 1 separately from the post-processing device 100.

The plurality of feed rollers 11 may be arranged on the feed path 7 and may move the printing paper P on which an image is formed, toward the eject roller 13. The eject roller 13 may be arranged at an end portion of the feed path 7 and may move the printing paper P toward the loading portion 120.

The loading portion 120 may be provided at one side and a lower side of the eject roller 13 and may load printing papers moved by the eject roller 13 on an upper surface of the loading portion 120. In this case, rear ends of a plurality of printing papers may be aligned on the loading portion 120 by the paddle device 110 that is described below before the plurality of printing papers are moved to the tray 170.

The loading portion 120 may be inclined in a downward direction toward the end fence 125 formed behind the loading portion 120 to load and easily align printing papers ejected from the eject roller 13.

The loading portion 120 may be spaced apart from the eject roller 13 in a direction toward a lower portion of the post-processing device 100 to easily eject a printing paper from the eject roller 13 without collision with a plurality of printing papers even if a plurality of printing papers ejected from the eject roller 13 are loaded to a predetermined height.

An upper surface of the loading portion 120 may be inclined and, thus, one lateral end of the printing papers P loaded on the loading portion 120 may be supported by the alignment members 123*a* and 123*b* that are described below.

The paddle device 110 for moving the printing paper P loaded on the loading portion 120 and enabling one lateral end of the printing paper P to be supported by the end fence 125 may be arranged on the loading portion 120.

A rear end of the printing papers P moved to the loading portion 120 may be in contact with a rear end of the moved printing paper P and may be aligned and, thus, the end fence 125 may be arranged behind the loading portion 120 to perform an operation, for example, a job for easily holding or stapling the printing paper P by the stapler device 130.

A printing paper provided to the post-processing device 100 may be loaded and aligned in an area surrounded by the loading portion 120 and the end fence 125.

The paddle device 110 may be spaced apart from an upper surface of the loading portion 120 by a predetermined distance and may move printing papers loaded on the loading portion 120 to a rear side of the loading portion 120 to align the loaded printing papers.

Referring to FIG. 4, the paddle device 110 may include a driving motor 111 that is normally or reversely rotated, a driving shaft 113 rotated by driving force of the driving motor 111, and at least one paddle 115 that is mounted on the driving shaft 113 and is rotated by rotation of the driving shaft 113 to align the printing papers P while comes in contact with the printing paper P.

The driving shaft 113 may extend in a width direction of a printing paper to be normally and reversely rotated by driving force of the driving motor 111.

The at least one paddle 115 may extend in a tangential direction of the driving shaft 113 from an outer circumference surface of the driving shaft 113 while maintained at a predetermined interval from the driving shaft 113 in a rotation direction.

The at least one paddle 115 may be coupled to the driving shaft 113 at a predetermined interval. The plurality of paddles 115 may be symmetrically arranged with each other based on the driving shaft 113 and may be arranged at different angles. The at least one paddle 115 coupled to the driving shaft 113 may be rotated by the driving shaft 113. In this case, the paddle 115 xray contact the printing paper via rotation thereof.

When the driving motor 111 is normally rotated, the driving shaft 113 and the at least one paddle 115 installed on the driving shaft 113 may also be normally rotated. Through normal-rotation driving of the paddle device 110, the paddle 115 may closely align a rear end of the printing paper P moved to the loading portion 120, to the end fence 125.

On the other hand, when the driving motor 111 is reversely rotated, the driving shaft 113 and the at least one paddle 115 installed on the driving shaft 113 may also be reversely rotated. In this case, the stapler device 130 may hole the rear end of the printing paper P, which is closely aligned to the end fence 125. Through reverse-rotation driving of the paddle device 110, the printing paper P, a rear end of which is held, may be moved in an opposite direction to the end fence 125 to remove curling of the printing paper P.

Referring to FIG. 4, the pair of alignment members 123*a* and 123*b* may be arranged to face opposite lateral surfaces of the loading portion 120 to align the plurality of printing papers P loaded on the loading portion 120 in left and right directions. The pair of alignment members 123*a* and 123*b* may be spaced apart from each other in a width direction of the printing paper P and, thus, the two alignment members 123*a* and 123*b* may simultaneously support and align two portions of one lateral side of the printing papers P. The alignment members 123*a* and 123*b* may be aligned in the moving direction of a printing paper by the paddle device 110 and, then, may be repeatedly moved between positions determined by a user to align a plurality of printing papers in left and right directions.

The stapler device 130 may hold the printing papers P, a rear ends of which are aligned with respect to the end fence 125, at the end fence 125 arranged at a rear end of the loading portion 120. The stapler device 130 may staple the plurality of printing papers P aligned when a printing job is terminated. The stapler device 130 may be adjacently arranged to the end fence 125. The stapler device 130 may be moveably installed in the post-processing device 100 to staple various portions of the printing papers P loaded on the loading portion 120.

The ejector device 150 may be arranged at the center of the loading portion 120. The ejector device 150 may include guide members (not shown) that face each other at predetermined interval and a moving member (not shown) that is arranged to face an internal side of the guide member and is rotated according to a predetermined trajectory.

The ejector device 150 may move a plurality of printing papers aligned at the end fence 125 to an intermediate point of the loading portion 120 according to movement of the guide member. The ejector device 150 may grip rear end portions of the plurality of printing papers moved to the intermediate point of the loading portion 120 and eject the plurality of aligned printing papers to the tray 170 by the moving member.

Operations of the post-processing device 100 configured as described above are sequentially described below. Hereinafter, for convenience of description, a paper set may be set in a unit of two printing papers.

FIG. 5 is a diagram for explanation of an operation of aligning a rear end of a printing paper by a paddle device according to an example of the present disclosure. FIG. 6 is a diagram for explanation of an operation of removing paper curling by a paddle device according to an example of the present disclosure.

Referring to FIG. 5, the post-processing device 100 may move the printing paper P dropped to the loading portion 120 in the moving direction by the eject roller 13 at a time point when the printing paper P ejected toward the loading portion 120 deviates from the eject roller 13. Here, the moving direction may refer to a backward direction of the loading portion 120 including the end fence 125 formed thereon to align a rear end of the printing paper P.

The paddle 115 may be mounted at a point spaced apart from the driving shaft 113 by a predetermined distance and may come in contact with an upper surface of the printing paper P dropped to the loading portion 120 while rotated by the driving motor 111 and the driving shaft 113 to align the printing paper P with respect to the end fence 125. Here, the paddle 115 may be mounted on the driving shaft 113 and the driving shaft 113 may receive driving force of the driving motor 111 through a train gear 117.

The paddle device 110 may be driven to be normally rotated to move the printing paper P. When the driving motor 111 is driven to be normally rotated, the driving shaft 113 may be normally rotated through the train gear 117 connected to the driving motor 111. Accordingly, the paddle 115 may be normally (in a clockwise direction in FIG. 5) rotated by the driving motor 111.

Referring to FIG. 5, the printing paper P1 loaded on an uppermost end of the loading portion 120 may be moved in a moving direction by the at least one paddle 115 of the paddle device 110. The paddle 115 may come in contact with an upper surface of the printing paper P1 dropped to the loading portion 120 while normally rotated and, thus, may move the printing paper P1 to a rear side of the loading portion 120. The printing paper P1 moved in a direction toward the end fence 125 may contact the end fence 125 of the loading portion 120 and, thus, a rear end of the printing paper may be aligned. A rear end of the printing paper P1 at an uppermost end may be aligned to be positioned at the same line as a rear end of the loaded printing papers P.

The paddle 115 may hit the ejected printing paper P1 in the moving direction while is rotated and, in this case, the printing paper may be moved to the end fence 125 by impulsive force and frictional force applied to the printing paper P1.

However, when many images are formed on the printing paper P1, the printing paper P1 includes much moisture and, thus, may be easily deformed. The printing paper P1 may be deformed by impulsive force and frictional force that are applied while the printing paper P1 is moved toward the end fence 125. That is, the printing paper P1 may be bent to curl during a procedure of aligning the printing paper P1. When the printing paper P1 curls, the number of printing papers loaded on the loading portion 120 may be reduced and, thus, there may be a limit in terms of a space of a post-processing device.

The image forming apparatus 1 may move the other end of the printing paper P1 aligned on the loading portion 120 in an opposite direction to the moving direction to prevent the printing paper P1 from curling which may occur during an alignment procedure of the printing paper P. FIG. 6 illustrates operations of the stapler device 130 and the paddle device 110 for moving the other end of the printing paper P1 in an opposite direction to the moving direction.

Referring to FIG. 6, when the ejected printing paper P1 is moved in the moving direction, the stapler device 130 may hold one end of the plurality of loaded printing papers P. In this case, the stapler device 130 may hold all of the plurality of printing papers P that are moved in the moving direction and aligned.

A tweezers portion 131 of the stapler device 130 may be rotated toward the printing paper P to hold one end of the plurality of printing papers P. In this case, the stapler device 130 may operate in a holding mode and the tweezers portion 131 may simply hold the plurality of printing papers P to fix one end of the plurality of printing papers P but may not staple the printing paper through a pin.

One end of the plurality of the loaded printing papers P may be held by the stapler device 130 and, then, the paddle device 110 may be driven to be reversely rotated to move the other end of the loaded printing paper P1 in an opposite direction to the moving direction.

The paddle device 110 may be driven to be reversely rotated to prevent a printing paper from curling which may occur during an alignment procedure of the printing paper P. When the driving motor 111 is driven to be reversely rotated, the driving shaft 113 may be reversely rotated through the train gear 117 connected to the driving motor 111. Accordingly, the paddle 115 may be reversely (in a counterclockwise direction in FIG. 6) rotated by the driving motor 111.

The at least one paddle 115 of the paddle device 110 may contact an upper surface of the printing paper P1 aligned with respect to a rear side of the loading portion 120 while reversely rotated and, thus, may move the other end of the printing paper P1, which is not held, in an opposite direction to the moving direction.

The paddle 115 may spread a fore end of the printing paper P1 in an opposite direction to the moving direction while reversely rotated, thereby removing paper curling. Accordingly, even if a rear end of the aligned printing paper P1 slips, that is, the printing paper P1 curls (refer to dotted lines of FIG. 6), the paddle device 110 may be driven to be reversely rotated to move a fore end of the printing paper P1, which is not held, in an opposite direction to the moving direction and, thus, the paddle device 110 may prevent a printing paper from curling.

FIG. 7 is a flowchart for explanation of a method for paper alignment according to an example of the present disclosure.

Referring to FIG. 7, the image forming apparatus 1 may form an image on the printing paper P using the printing engine 30 (S710).

The image forming apparatus 1 may provide the printing paper P on which an image is formed, to the post-processing device 100 (S720). The printing papers P provided to the post-processing device 100 may be aligned and various post-processing jobs may be performed on the printing papers P.

The paddle device 110 may move the printing paper P provided to the post-processing device 100 in the moving direction to align one end of the printing paper P (S730). In the aligning of the one end of the printing paper P, when the printing paper P with an image formed thereon is provided to the post-processing device 100 from the printing engine 30, the paddle device 110 may be normally rotated. A paddle connected to the driving motor 111 may be driven to be reversely rotated by reverse rotation of the paddle device 110. The printing paper P may be moved in a moving direction corresponding to a rear side of the loading portion 120 via normal rotation of the paddle 115 and a rear end of the moved printing paper P may be aligned by the end fence 125.

The stapler device 130 may hold one end of the aligned printing paper P (S740). In the holding of the one end of the printing paper P by the stapler device 130, the one end of the printing paper P loaded on the loading portion 120 may be held using a holding mode of the stapler device 130 during a printing job for printing a plurality of sheets.

The paddle device 110 may move the other end of the aligned printing paper in an opposite direction to the moving direction after the one end of the printing paper is held (S750). In the moving of the other end of the aligned printing paper P in an opposite direction to the moving direction, a rear end of the printing paper P may be aligned and, then, the paddle device 110 may be reversely rotated to move the other end of the aligned printing paper P in an opposite direction to the moving direction. A paddle connected to the driving motor 111 may be driven to be reversely rotated via reverse rotation of the paddle device 110. The other end of the printing paper P, which is not held, may be moved in an opposite direction to the moving direction to spread the printing paper P via reverse rotation of the paddle 115. The printing paper may be prevented from curling, which may occur during a paper alignment procedure, via reverse-rotation driving of the paddle device 110.

When a printing job for printing a plurality of sheets is terminated, the stapler device 130 may staple one end of the printing paper. The stapler device 130 may bond the plurality of the printing paper P into one set using a stapling mode.

The post-processed printing paper P or the printing paper P that is aligned without a post-processing job may be moved to the tray 170 from the loading portion 120 by the ejector device 150. For example, the plurality of printing papers P stapled by the stapler device 130 may be ejected to the tray 170 by the ejector device 150.

The aforementioned paper alignment method according to the example may be embodied in a program and provided to an image forming apparatus. In particular, a program including the paper alignment method may be stored and provided in a non-transitory computer readable medium for recording thereon.

The non-transitory computer readable medium is a medium that semi-permanently stores data and from which data is readable by a device, but not a medium that stores data for a short time, such as register, a cache, a memory, and the like. In detail, the aforementioned various applications or programs may be stored in the non-transitory computer readable medium, for example, a compact disc (CD), a digital versatile disc (DVD), a hard disc, a bluray disc, a universal serial bus (USB), a memory card, a read only memory (ROM), and the like, and may be provided.

The foregoing examples are not to be construed as limiting the present disclosure. The present teaching can be readily applied to other types of apparatuses. Also, the description of the examples of the present disclosure is intended to be illustrative, and not to limit the scope of the claims, and many examples, modifications, and variations will be apparent to those skilled in the art.

What is claimed is:

1. An image forming apparatus including:

a printing engine to form an image on a printing paper;

a paddle device to move the printing paper ejected from the printing engine in a moving direction to align a first end of the printing paper;

a stapler device to staple the aligned printing paper; and a processor to control the paddle device and the stapler device to move a second end of the aligned printing paper in an opposite direction to the moving direction when the first end of the printing paper is aligned.

2. The image forming apparatus as claimed in claim 1, wherein the processor controls the stapler device to hold the first end of the aligned printing paper when the first end of the printing paper is aligned and controls the paddle device to move the second end of the aligned printing paper in the opposite direction of the moving direction after the first end of the aligned printing paper is held.

3. The image forming apparatus as claimed in claim 1, wherein the processor controls the paddle device and the stapler device to move the second end of the aligned printing paper in the opposite direction to the moving direction for each ejected printing paper.

4. The image forming apparatus as claimed in claim 1, wherein the stapler device has a holding mode in which the first end of the aligned printing paper is held and a stapling mode in which the first end of the aligned printing paper is stapled; and wherein the processor controls the stapler device to operate in the holding mode during a printing job, the printing job including printing a plurality of sheets, and wherein the processor controls the stapler device to operate in the stapling mode when the printing job is terminated.

5. The image forming apparatus as claimed in claim 1, wherein the paddle device includes:

a driving motor to be normally or reversely rotated;

a driving shaft rotated by driving force of the driving motor; and at least one paddle located on the driving shaft and rotated via rotation of the driving shaft to align the printing paper while contacting the printing paper.

6. The image forming apparatus as claimed in claim 5, wherein the processor controls the driving motor to normally rotate the paddle when the printing paper is ejected from the printing engine, and the processor controls the driving motor to reversely rotate the paddle when the printing paper is aligned.

7. The image forming apparatus as claimed in claim 6, wherein the processor controls the driving motor to rotate the paddle in such a way that at least one of driving time and driving speed at which the paddle is reversely rotated is different from a driving state in which the paddle is normally rotated.

8. The image forming apparatus as claimed in claim 1, further including:

a loading portion to load the ejected printing paper; and an end fence to align the first end of the printing paper loaded by the paddle device.

9. The image forming apparatus as claimed in claim 8, further including:

a tray to load a plurality of printing papers aligned by the paddle device or a plurality of printing papers stapled by the stapler device; and an ejector device to move the plurality of aligned printing papers or the plurality of stapled printing papers to the tray from the loading portion.

10. A method of aligning a printing paper by an image forming apparatus, the method including:

forming an image on a printing paper;

providing the printing paper on which the image is formed, to a post-processing device;

moving the provided printing paper in a moving direction to align a first end of the printing paper;

holding the first end of the aligned printing paper; and moving a second end of the aligned printing paper in an opposite direction to the moving direction after the first end of the aligned printing paper is held.

11. The method as claimed in claim 10, wherein the holding of the first end of the printing paper includes holding the first end of the printing paper using a holding mode of a stapler device during a printing job, the printing job including printing a plurality of sheets.

12. The method as claimed in claim 10, further including stapling the first end of the aligned printing paper using a stapling mode when a printing job is terminated, the printing job including printing a plurality of sheets.

13. The method as claimed in claim 12, further including moving the plurality of stapled printing papers to a tray.

14. The method as claimed in claim 10, wherein the moving the provided printing paper in a moving direction to align the first end of the printing paper includes normally rotating a paddle when the printing paper, on which the image is formed, is provided; and wherein the moving the second end of the aligned printing paper includes reversely rotating the paddle when the printing paper is aligned.

15. The method as claimed in claim 14, wherein at least one of driving time and driving speed at which the paddle is reversely rotated is different from a driving state in which the paddle is normally rotated.

* * * * *